US007048073B2

(12) United States Patent
Hezeltine

(10) Patent No.: US 7,048,073 B2
(45) Date of Patent: May 23, 2006

(54) FASTENER INSTALLATION SYSTEMS

(75) Inventor: Alton W. Hezeltine, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/655,822

(22) Filed: Sep. 5, 2003

(65) Prior Publication Data

US 2004/0045728 A1 Mar. 11, 2004

Related U.S. Application Data

(62) Division of application No. 09/821,247, filed on Mar. 29, 2001, now Pat. No. 6,622,802.

(51) Int. Cl.
*E21B 1/24* (2006.01)

(52) U.S. Cl. ..... 173/1; 173/115; 173/128; 173/132

(58) Field of Classification Search ..... 173/1, 173/115, 128, 132; 227/10, 130, 147; 137/488
See application file for complete search history.

(56) References Cited

U.S. PATENT DOCUMENTS 2,619,072 A * 11/1952 Clarke, Jr. et al. ..... 91/40
3,111,997 A * 11/1963 Krembel, Jr. ..... 173/15
3,393,755 A * 7/1968 Glaser et al. ..... 173/200
3,561,542 A * 2/1971 Hanson et al. ..... 173/1
3,818,799 A * 6/1974 Hague ..... 91/40
3,823,784 A * 7/1974 Feucht ..... 173/1
3,850,359 A * 11/1974 Obergfell ..... 227/10
4,040,164 A 8/1977 Briles ..... 29/432
4,213,301 A 7/1980 Maier et al. ..... 60/407
4,259,858 A * 4/1981 Freeman et al. ..... 29/243.523
4,463,888 A 8/1984 Geist et al. ..... 227/109
4,754,643 A * 7/1988 Weeks et al. ..... 29/812.5
4,790,470 A 12/1988 Miles ..... 227/1
4,811,881 A * 3/1989 Heck ..... 227/4
5,352,230 A * 10/1994 Hood ..... 606/99
5,437,339 A 8/1995 Tanaka ..... 173/210
5,515,930 A * 5/1996 Glaser ..... 173/115
5,653,368 A 8/1997 Miles et al. ..... 227/2
5,857,485 A * 1/1999 Perkins et al. ..... 137/487.5
6,079,604 A 6/2000 Banducci et al. ..... 227/112
6,095,256 A 8/2000 Lindsay ..... 173/115
6,772,784 B1 * 8/2004 Jones et al. ..... 137/102

* cited by examiner

*Primary Examiner*—Rinaldi I. Rada
*Assistant Examiner*—Nathaniel C. Chukwurah
(74) *Attorney, Agent, or Firm*—Schwegman, Lundberg, Woessner & Kluth, P.A.

(57) ABSTRACT

A fastener installation tool to install fasteners, such as rivets, risers, standoffs, and other types of fasteners operates upon vacuum and air pressure. Fasteners are installed with minimal reactive forces to the operator's hand, thus reducing the risk of repetitive injuries to the operator's body. Vacuum retains the fastener within the tool tip and retracts a piston, until an operator simultaneously presses the fastener against a work piece and actuates an actuation element on the tool. This causes air pressure to quickly thrust the piston against a hammer pin to drive in the fastener, transferring kinetic energy from the piston to the fastener without appreciable kick-back to the operator. A control system provides a source of vacuum and air pressure to the tool. Methods of using a fastener installation tool are also described.

8 Claims, 12 Drawing Sheets

FASTENER INSTALLATION SYSTEMS

This application is a divisional of U.S. patent application Ser. No. 09/821,247, filed Mar. 29, 2001, now issued as U.S. Pat. No. 6,622,802, which is incorporated herein by reference.

TECHNICAL FIELD

Embodiments of the inventive subject matter relate generally to the field of component assembly and, more particularly, to fastener installation tools and to associated systems and methods.

BACKGROUND INFORMATION

The area of component assembly requires a wide variety of fasteners to secure components to each other and to higher levels of organization, such as circuit boards, sub-assemblies, assemblies, electronic and electrical chassis, appliances, vehicles, containers, cabinets, and many other kinds of consumer, commercial, and military products. Fasteners used in association with the above equipment can be made of different types of materials, including plastic and metal. Such fasteners include rivets for securing one item to another. They also include spacers, risers, or standoffs for spacing one item from another.

In contemporary high production manufacturing environments, fasteners must be inserted at a high rate, either by human operators or by robots. Robot equipment is complex, requiring high start-up and maintenance costs, and it often necessitates extensive time-consuming installation of new equipment and/or retooling and modification whenever a different type of fastener or a different configuration of fasteners is needed. Human operated equipment is regulated by federal, state, and local laws and regulations, and it must be safe and ergonomic for human use in addition to being easy to use, reliable, inexpensive to purchase and operate, and efficient.

Various types of tools for inserting fasteners are known, including tools that are pneumatically, hydraulically, and/or electrically operated. However, many of these tools are not safe and ergonomic, in that they are bulky, unwieldy, and produce substantial reactive kick-back to the hand(s) of a human operator, thus subjecting the operator to potential injury, including repetitive injury, resulting from stress to the hand, wrist, arm, shoulder, neck, and back. Such injuries can result in sick time, lost work days, employee dissatisfaction, disability payments, litigation, and governmental sanctions.

For the reasons stated above, and for other reasons stated below which will become apparent to those skilled in the art upon reading and understanding the present specification, there is a significant need in the art for a fastener installation tool that is light-weight, that produces little if any kick-back to a human operator, and that is inexpensive and easy to operate.

DETAILED DESCRIPTION

Figure 1:
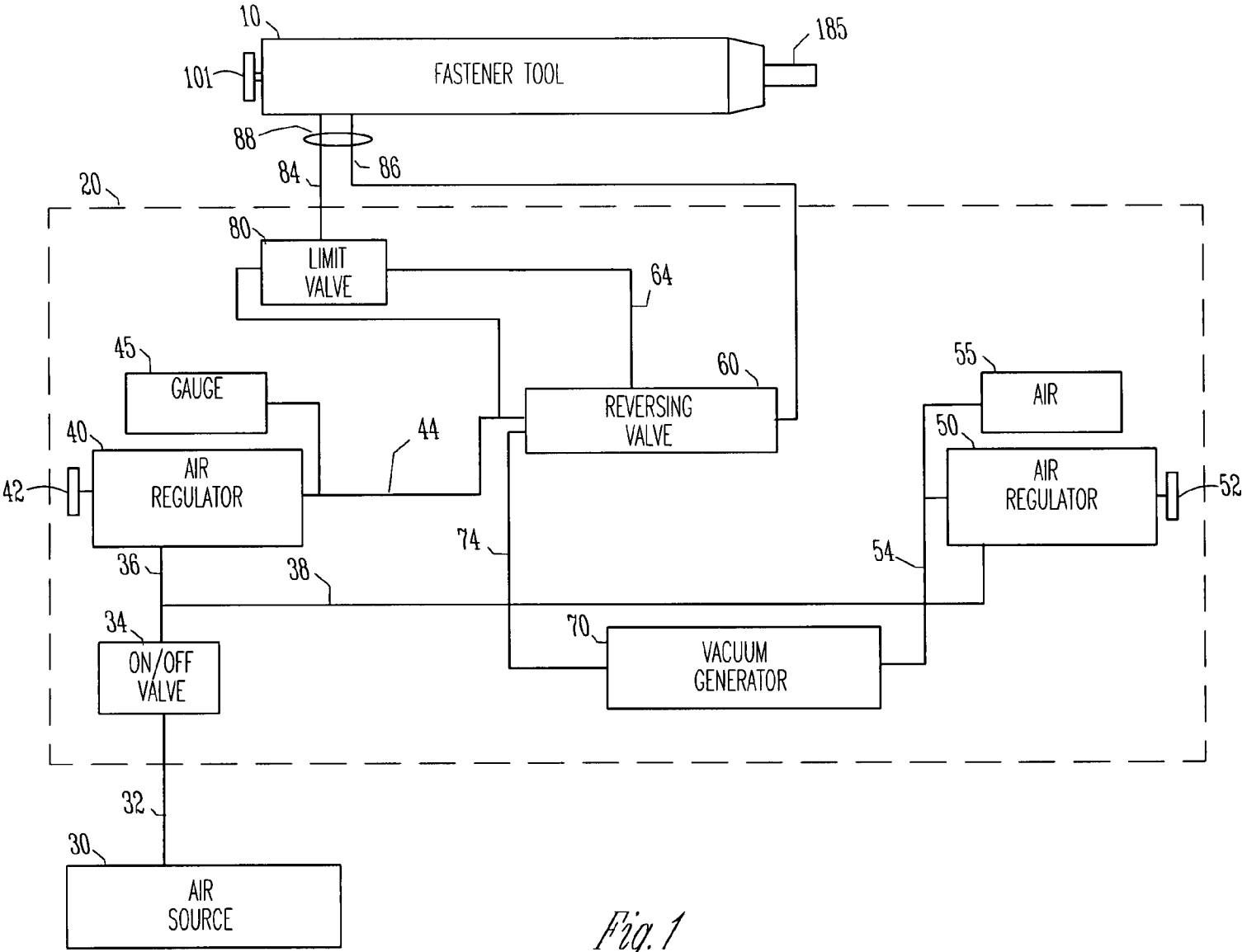
FIG. 1 illustrates a block diagram of a fastener installation tool and its associated control system, in accordance with one embodiment of the invention.

In the following detailed description of embodiments of the invention, reference is made to the accompanying drawings which form a part hereof, and in which is shown by way of illustration specific preferred embodiments in which the inventive subject matter may be practiced. These embodiments are described in sufficient detail to enable those skilled in the art to practice them, and it is to be understood that other embodiments may be utilized and that architectural, structural, compositional, mechanical, and electrical changes may be made without departing from the spirit and scope of the inventive present subject matter. The following detailed description is, therefore, not to be taken in a limiting sense, and the scope of embodiments of the present invention is defined only by the appended claims. Such embodiments of the inventive subject matter may be referred to, individually and/or collectively, herein by the term "invention" merely for convenience and without intending to voluntarily limit the scope of this application to any single invention or inventive concept if more than one is in fact disclosed.

Embodiments of the inventive subject matter provide a solution to the problem of bulky, unwieldy, and non-ergonomic fastener installation tools by providing a light-weight, hand-held, non-electrified fastener installation tool that generates minimal kick-back to the tool operator.

According to one embodiment illustrated and described herein, a fastener installation tool includes a body having a chamber that contains a movable piston-like primary hammer. The tool body further comprises a nose piece having a channel therein. A secondary hammer has a pin that moves within the nose channel. A control system is coupled to the tool body via a pilot hose and a supply hose. The supply hose provides either vacuum or pressurized air to the tool, depending upon the state of a control mechanism in the control system. The pilot hose is coupled between the control mechanism and a pair of actuation elements on the tool that must be simultaneously moved or actuated by an operator to fire the tool.

In a standby mode, vacuum is supplied to the tool through the supply hose to retract the primary hammer and to retain a fastener within the nose piece. The concurrent actuation of both actuation elements causes pressurized air to be supplied to the tool through the supply hose to quickly thrust the primary hammer against the secondary hammer. The pin of the secondary hammer strikes the fastener to insert it into a work piece. By using interchangeable tool tips, many different types of fasteners, spacers, risers, standoffs, and the like can be inserted by the tool. Various methods of using a fastener installation tool are also described.

The inventive subject matter, as implemented in various embodiments, provides an ergonomic tool that generates only minimal kick-back to its operator, thus reducing the likelihood of repetitive stress type injuries to the operator. A fastener installation tool implemented in accordance with the inventive subject matter is relatively inexpensive and is easy to use.

FIG. 1 illustrates a block diagram of a fastener installation tool 10 and its associated control system 20, in accordance with one embodiment of the invention. Fastener installation tool 10 comprises an actuation element or button 101 to be actuated by an operator. Although actuation button 101 is illustrated as positioned at the back of tool 10, it could be located elsewhere on tool 10. And although actuation button 101 is illustrated as being a depressible member, it could be implemented in any other suitable manner, such as with a member that slides, pulls, twists, and so forth.

Fastener installation tool 10 also comprises a tip adapter 185 into which the operator can position a fastener or other device to be driven by tool 10. Although fastener installation tool 10 is illustrated as generally cylindrical in FIG. 1, the inventive subject matter can be implemented in any shape or structure.

Fastener installation tool 10 is coupled via a hose arrangement 88 to control system 20. In one embodiment, hose arrangement 88 comprises a supply hose 86 and a pilot hose 84, the purpose of which will be described further below. In other embodiments, more or fewer hoses could be used in hose arrangement 88.

Control system 20 comprises a connection 32 to an air source 30 that provides pressurized air. On/off valve 34 is coupled to connection 32. From on/off valve 34, air is coupled to air lines 36 and 38. Air regulator 40 is coupled to air line 36, and air regulator 50 is coupled to air line 38. Air regulator 40 comprises an adjustment knob 42, and air regulator 50 comprises an adjustment knob 52. Coupled to air line 44 at the output of air regulator 40 is air pressure gauge 45, and coupled to air line 54 at the output of air regulator 50 is air pressure gauge 55. Adjustment knobs 42 and 52 can be adjusted by an operator so that gauges 45 and 55, respectively, indicate desired air pressure values within air lines 44 and 54, respectively.

Vacuum generator 70 is coupled to air line 54, and it provides vacuum within vacuum line 74. Limit valve 80 is coupled to air line 44, to pilot hose 84, and to line 64. Reversing valve 60 is coupled to air line 44, to vacuum line 74, to line 64, and to supply hose 86.

"Air pressure" or "pressurized air" is used herein to mean air having a pressure that is greater than atmospheric pressure. "Vacuum" is used herein to mean air having a pressure that is less than atmospheric pressure.

The operation of the various components of control system 20 is explained in detail below under the heading "Operation".

Figure 2:
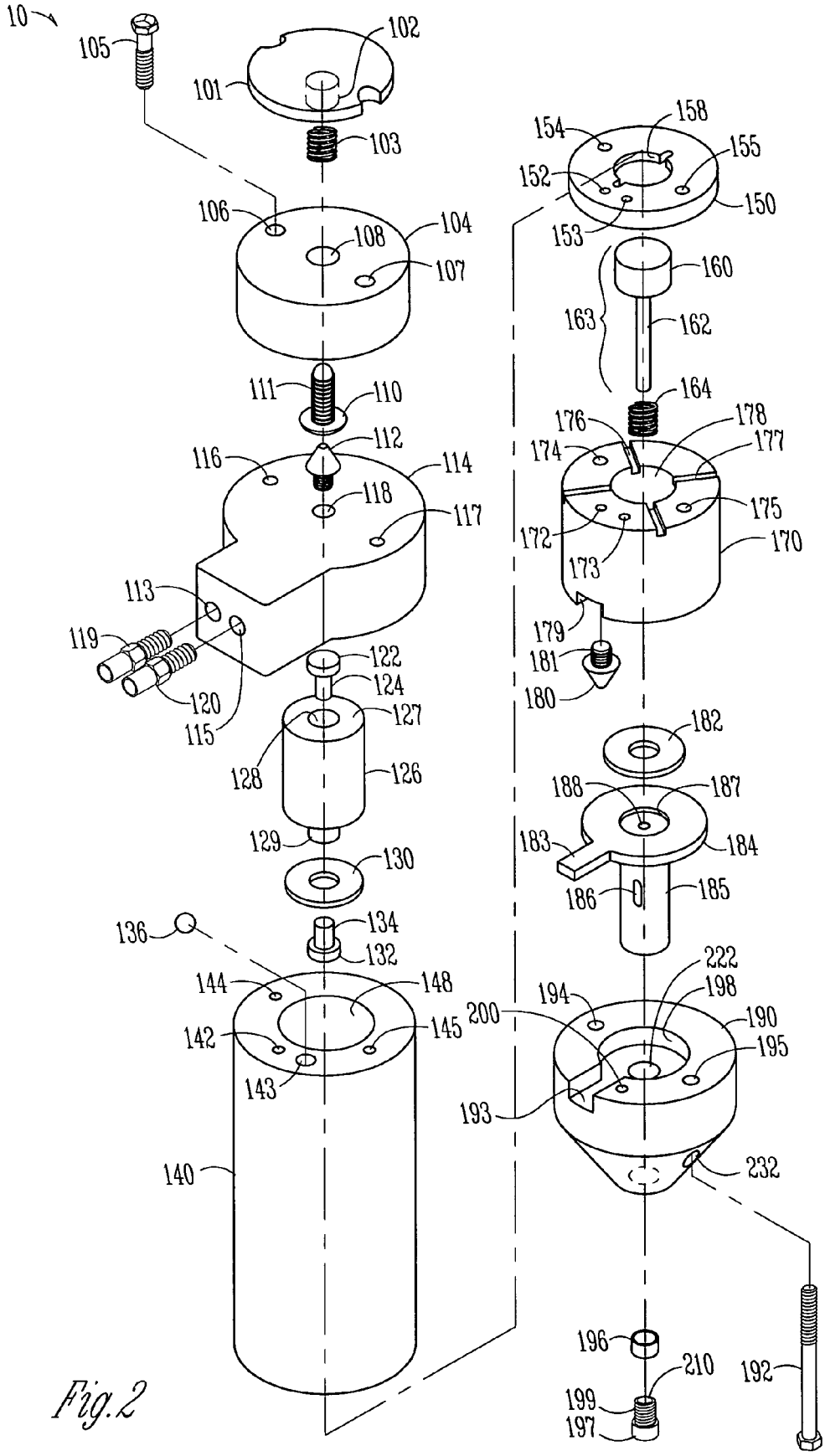
FIG. 2 illustrates an exploded diagram of a fastener installation tool, in accordance with one embodiment of the invention.

FIG. 2 illustrates an exploded diagram of a fastener installation tool 10, in accordance with one embodiment of the invention. The various components of this embodiment of tool 10 will now be discussed from top to bottom in FIG. 2. Unless otherwise indicated, the components are fabricated of aluminum, although they could be fabricated of other materials in other embodiments.

Actuation button 101, fabricated of stainless steel, has a hollow shaft 102 that passes through button return spring 103 and into recess 108 and through bore 205 (refer to FIGS. 5–7) of button end cap 104, where its hollow shaft 102 mates with ribbed shaft 111 of button tab 110. Button tab 110 can be fabricated of plastic, rubber, or metal. In one embodiment, button tab 110 is a plastic tree rivet. Button end cap 104 also comprises a pair of holes 106 and 107 into which button assembly bolts 105 (only one of which is illustrated in FIG. 2) are inserted.

Input manifold 114 comprises a pair of threaded inlets 113 and 115 that accommodate the threaded ends of pilot hose adapter 119 and supply hose adapter 120, respectively. The nipple ends of pilot hose adapter 119 and supply hose adapter 120 are coupled to pilot hose 84 and supply hose 86 (FIG. 1), respectively.

Input manifold 114 also comprises a partially threaded channel 118 into which a threaded rubber air pilot gasket or vent 112 is inserted. Input manifold 114 also comprises a pair of holes 116 and 117 into which button assembly bolts 105 (only one of which is illustrated in FIG. 2) pass from holes 106 and 107, respectively, of button end cap 104.

Input manifold 114 also comprises additional holes and channels that are best viewed in FIGS. 8–12 discussed below.

Primary hammer 126 is cylindrical and has a core 127 fabricated of steel. Hammer 126 lies within a relatively thin plastic sleeve (not shown) to improve durability. Hammer 126 comprises a cylindrical head 129 protruding from its lower end. Hammer 126 has a hole 128 in its upper end into which the shaft 124 of upper bumper 122 is securely fitted. Hammer 126 also has a hole (not shown) in its lower end into which the shaft 134 of lower bumper 132 is securely fitted. Washer 130 is dimensioned to fit securely over head 129 and against the lower end of hammer 126. Upper bumper 122, lower bumper 132, and washer 130 are fabricated of polyurethane or other durable, resilient material. Primary hammer 126 moves like a piston within central chamber 148 of body 140, next described below.

Body 140 is a cylindrical piece having a central chamber 148, a pair of channels 142 and 143 to convey air and/or vacuum, and a pair of holes 144 and 145 into which button assembly bolts 105 (only one of which is illustrated in FIG. 2) pass from holes 116 and 117, respectively, of input manifold 114. Button assembly bolts 105 are screwed into holes 144 and 145 in order to secure button end cap 104, input manifold 114, and body 140 together. The upper end (shown) of air/vacuum channel 143 is slightly enlarged to accommodate a stainless steel ball 136.

Center plate 150, fabricated of stainless steel, has a central aperture 158, a pair of channels 152 and 153 to convey air and/or vacuum, and a pair of holes 154 and 155 into which nose piece assembly bolts 192 (only one of which is illustrated in FIG. 2) pass from holes 174 and 175, respectively, of pin receptor 170 (discussed below). Nose piece assembly bolts 192 are screwed into holes 154 and 155 to secure nose piece 190, pin receptor 170, center plate 150, and body 140 together. Center plate 150 functions as an exhaust baffle, in that its outer wall (refer to FIG. 17) extends down and over, but spaced outwardly from, the exterior openings of channels 176 and 177 to prevent the operator's hand from blocking the venting of air when tool 10 is actuated and primary hammer 126 is being propelled within central chamber 148.

Secondary hammer assembly 163 comprises secondary head 160, which is a solid cylinder of steel having a central hole into which is secured a steel shaft or hammer pin 162. Primary hammer 126, discussed above, has relatively more mass than the secondary hammer assembly 163. Hammer pin 162 passes through hammer assembly return spring 164. Secondary head 160 moves within central chamber 178 of pin receptor 170, next described below.

Pin receptor 170 comprises a central chamber 178, a pair of channels 172 and 173 to convey air and/or vacuum, and a pair of holes 174 and 175 through which nose piece assembly bolts 192 (only one of which is illustrated in FIG. 2) pass from holes 194 and 195, respectively, of nose piece 190 (discussed below). Pin receptor 170 further comprises a pair of channels 176 and 177 in its upper surface. Channels 176 and 177 are intersected by central chamber 178. Channels 176 and 177 enable the venting of air when tool 10 is actuated and primary hammer 126 is being propelled within central chamber 148.

In addition, pin receptor 170 comprises a pair of channels 169 and 171 (FIG. 20) in its lower surface. Channels 169 and 171, like channels 176 and 177, also enable the venting of air from central chamber 148 when tool 10 is actuated and primary hammer 126 is being propelled by air pressure within central chamber 148. Channels 169 and 171 are intersected by central chamber 178. In the lower surface of pin receptor 170 is a partial channel or opening 179 (refer also to FIG. 20) coupled to channel 172 having a threaded portion 204 into which the threaded shaft 181 of a rubber air pilot gasket or vent 180 is inserted.

A polyurethane washer 182 is positioned in contact with the upper surface of tip adapter 185. Washer 182 reduces the effect of potentially damaging impact force between the lower surface of head 160 and the upper surface of tip adapter 185.

Tip adapter 185, fabricated of plastic, comprises a circular over-hanging member or flange 184 on its upper surface, and flange 184 has a tab 183. Flange 184 has a circular recess 187 in its upper surface. Tip adapter 185 has a central interior bore or channel 188 throughout its entire length, the lower portion 189 (refer to FIG. 23) of which is slightly enlarged and threaded. A hole 186 in one side of the cylindrical wall of tip adapter 185 communicates with channel 188. Hammer pin 162 of the secondary hammer assembly 163 lies within and moves within interior channel 188 of tip adapter 185. The lower end of hammer assembly return spring 164 fits into a recess 187 in the upper surface of tip adapter 185. The lower portion of tip adapter 185 lies within and can move a short distance within the central chamber 222 of nose piece 190, next described below.

Nose piece 190 has an opening 198 in its upper surface that is equivalent in shape to that of the flange 184 on the upper portion of tip adapter 185. Channel 193 accommodates tab 183 of tip adapter 185. Tip adapter 185 has a range of motion between a first position where tab 183 rests against the bottom surface of channel 193 and a second position where tab 183 rests against the opening of vent 180 of pin receptor. Nose piece 190 has an opening 200 in its upper surface that communicates with central chamber 222 via a passage 226 (refer to FIG. 25). Nose piece 190 also comprises a pair of bolt recesses 231 and 232 (refer to FIGS. 25 and 26) to receive nose piece assembly bolts 192 (only one of which is illustrated in FIG. 2).

Tip 197, fabricated of plastic, has a fastener channel 210 through its length. The upper end of tip 197 is threaded to mate with the threaded lower portion 189 of tip adapter 185. The threaded end of tip 197 is inserted through an optional identification band 196, fabricated of aluminum. Identification band 196 can be used, for example, to identify the type of fastener to be employed with this particular combination of tip adapter 185 and/or tip 197. Different types of fasteners can require different sizes and shapes of tip adapters 185 and/or tips 197.

Figure 3:
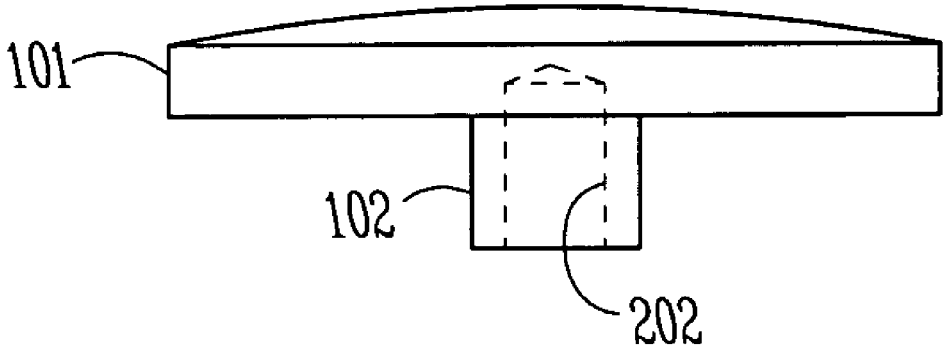
FIG. 3 illustrates a side view of an actuation button of a fastener installation tool, in accordance with one embodiment of the invention.

FIG. 3 illustrates a side view of an actuation button 101 of a fastener installation tool, in accordance with one embodiment of the invention. Button 101 comprises a hollow shaft 102 with a central, interior bore 202.

Figure 4:
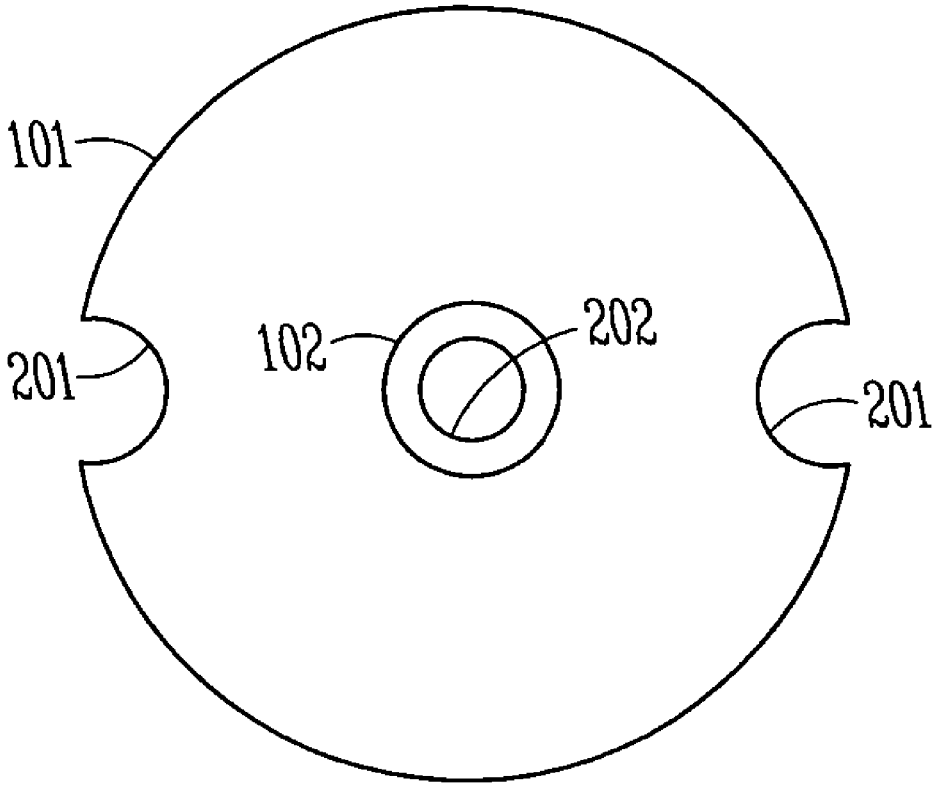
FIG. 4 illustrates a top view of the actuation button shown in FIG. 3.

FIG. 4 illustrates a top view of the actuation button 101 shown in FIG. 3. Button 101 has a pair of cut-away areas 201 to provide access to button assembly bolts 105 (FIG. 2).

Figure 5:
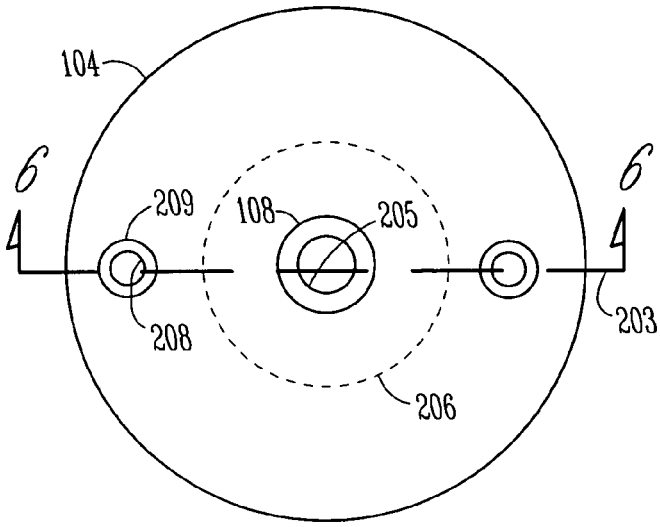
FIG. 5 illustrates a top view of a button end cap of a fastener installation tool, in accordance with one embodiment of the invention.

FIG. 5 illustrates a top view of a button end cap 104 of a fastener installation tool, in accordance with one embodiment of the invention. Button end cap 104 has a recess 108 in its upper surface and a central, interior bore 205 to a recess 206 in its lower surface.

Figure 6:
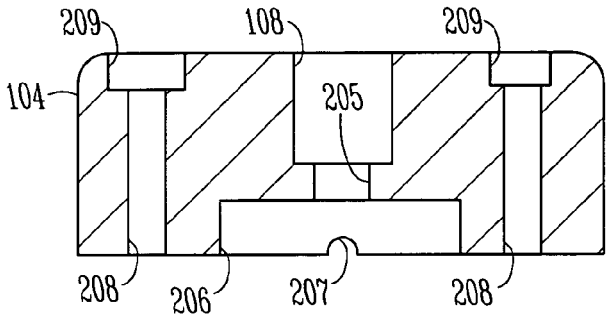
FIG. 6 illustrates a cross-sectional view of the button end cap shown in FIG. 5 taken along line 203 of FIG. 5.

FIG. 6 illustrates a cross-sectional view of the button end cap 104 shown in FIG. 5 taken along line 203 of FIG. 5. Button end cap 104 has a pair of bolt channels 208, whose upper portions 209 are slightly enlarged to accommodate the heads of button assembly bolts 105 (FIG. 2).

Figure 7:
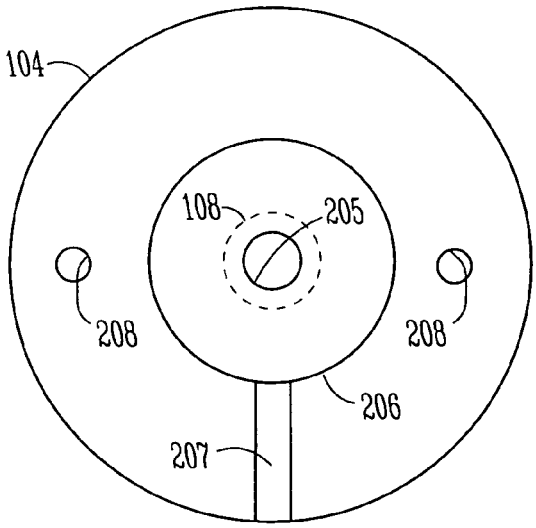
FIG. 7 illustrates a bottom view of the button end cap shown in FIG. 5.

FIG. 7 illustrates a bottom view of the button end cap 104 shown in FIG. 5. A channel 207 is provided in the lower surface of button end cap 104 from the exterior side wall of button end cap 104 to the interior side wall of recess 206.

Figure 8:
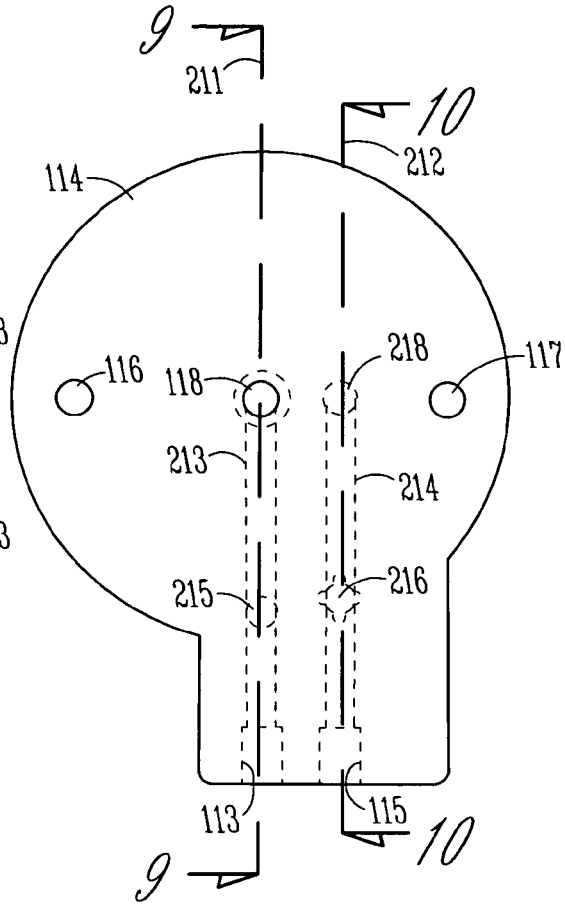
FIG. 8 illustrates a bottom view of an inlet manifold of a fastener installation tool, in accordance with one embodiment of the invention.

FIG. 8 illustrates a bottom view of an inlet manifold 114 of a fastener installation tool, in accordance with one embodiment of the invention. Seen in FIG. 8 are threaded inlets 113 and 115, threaded channel 118, and holes 116 and 117, all described earlier. Inlet manifold 114 also comprises channels 213 and 214. Channel 213 extends from inlet 113 to channel 118, while channel 214 extends from inlet 115 to a channel 218 that opens to the lower surface of inlet manifold 114.

Figure 9:
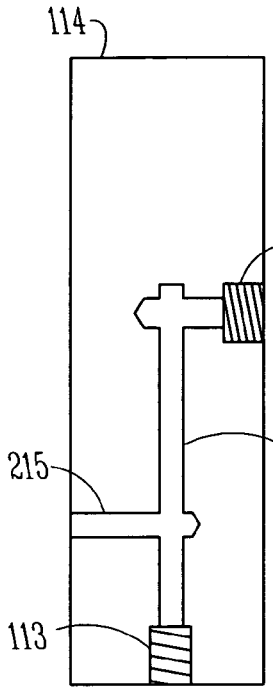
FIG. 9 illustrates a cross-sectional view of the inlet manifold shown in FIG. 8 taken along line 211 of FIG. 8.

FIG. 9 illustrates a cross-sectional view of the inlet manifold 114 shown in FIG. 8 taken along line 211 of FIG. 8. Channel 215 extends from channel 213 to the lower surface of inlet manifold 114, seen on the left-hand side of FIG. 9.

Figure 10:
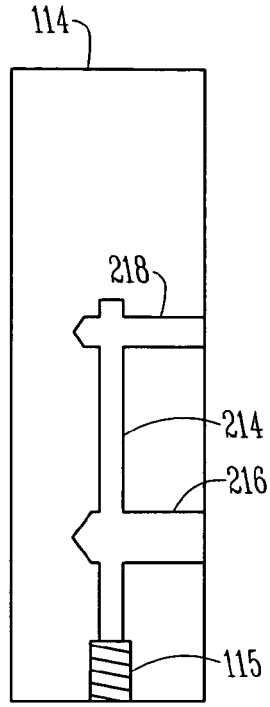
FIG. 10 illustrates a cross-sectional view of the inlet manifold shown in FIG. 8 taken along line 212 of FIG. 8.

FIG. 10 illustrates a cross-sectional view of the inlet manifold 114 shown in FIG. 8 taken along line 212 of FIG. 8. Channel 216 extends from channel 214, respectively, to the lower surface of inlet manifold 114, seen on the right-hand side of FIG. 10.

Figure 11:
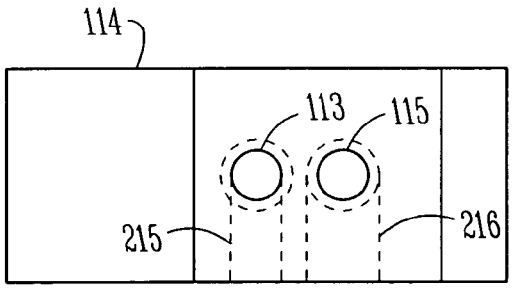
FIG. 11 illustrates a side view of the inlet manifold shown in FIG. 8.

FIG. 11 illustrates a side view of the inlet manifold 114 shown in FIG. 8. The view in FIG. 11 is looking into inlets 113 and 115. Channels 215 and 216 are seen in dashed lines. Channel 216 has a slightly larger profile than channel 215 due to the shape of channel 216, next to be described.

Figure 12:
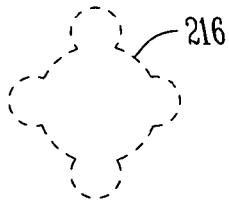
FIG. 12 illustrates a cross-sectional profile of channel 216 of the inlet manifold shown in FIG. 8.

FIG. 12 illustrates a cross-sectional profile of channel 216 of the inlet manifold 114 shown in FIG. 8. The cross-sectional profile of channel 216 can also have any of several alternative shapes, such as a diamond, cross, or X.

Figure 13:
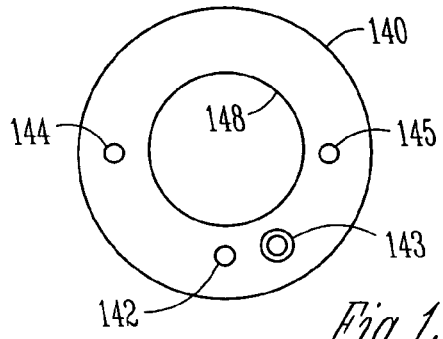
FIG. 13 illustrates a top view of a body section of a fastener installation tool, in accordance with one embodiment of the invention.

FIG. 13 illustrates a top view of a body section 140 of a fastener installation tool, in accordance with one embodiment of the invention. Shown in FIG. 13 are central chamber 148, channels 142 and 143 to convey air and/or vacuum, and threaded holes 144 and 145 into which button assembly bolts 105 are secured. All of these elements were described above with reference to FIG. 2.

Figure 14:
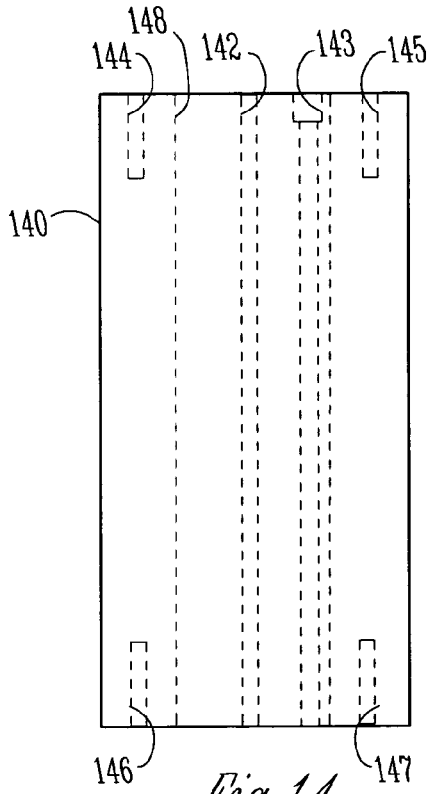
FIG. 14 illustrates a side view of the body section shown in FIG. 13.

FIG. 14 illustrates a side view of the body section 140 shown in FIG. 13. Shown in FIG. 14 are central chamber 148, channels 142 and 143, threaded holes 144 and 145, and threaded holes 146 and 147. All of these elements were described above with reference to FIG. 2.

Figure 15:
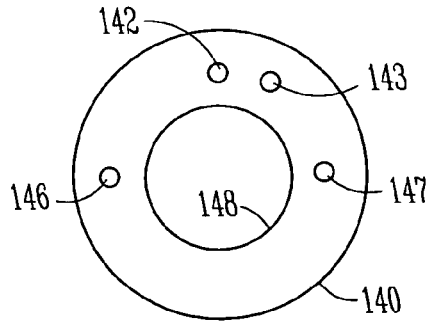
FIG. 15 illustrates a bottom view of the body section shown in FIG. 13.

FIG. 15 illustrates a bottom view of the body section 140 shown in FIG. 13. Shown in FIG. 15 are central chamber 148, channels 142 and 143, threaded holes 146 and 148 into which nose piece assembly bolts 192 are secured. All of these elements were described above with reference to FIG. 2.

Figure 16:
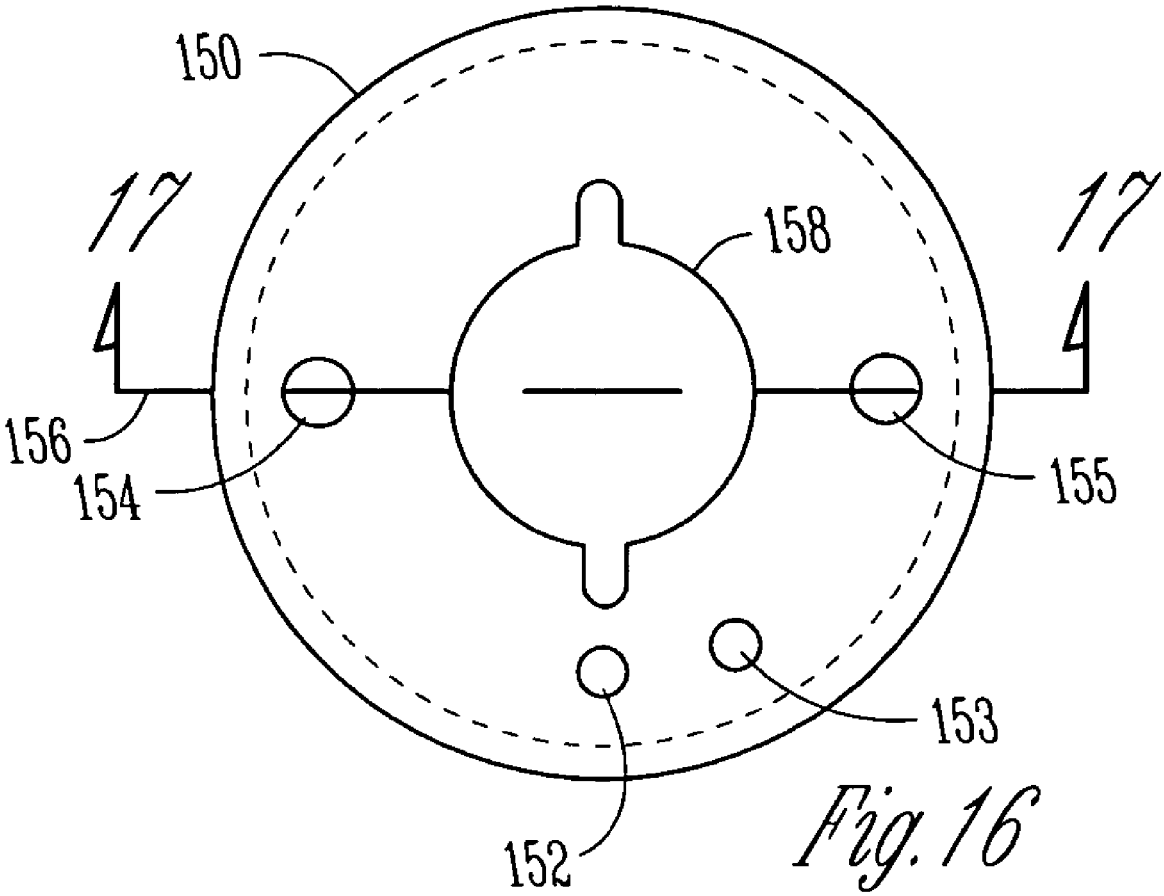
FIG. 16 illustrates a top view of a center plate of a fastener installation tool, in accordance with one embodiment of the invention.

FIG. 16 illustrates a top view of a center plate 150 of a fastener installation tool, in accordance with one embodiment of the invention. Seen in FIG. 16 are central aperture 158, channels 152 and 153 to convey air and/or vacuum, and holes 154 and 155 through which nose piece assembly bolts 192 pass. All of these elements were described above with reference to FIG. 2.

Figure 17:
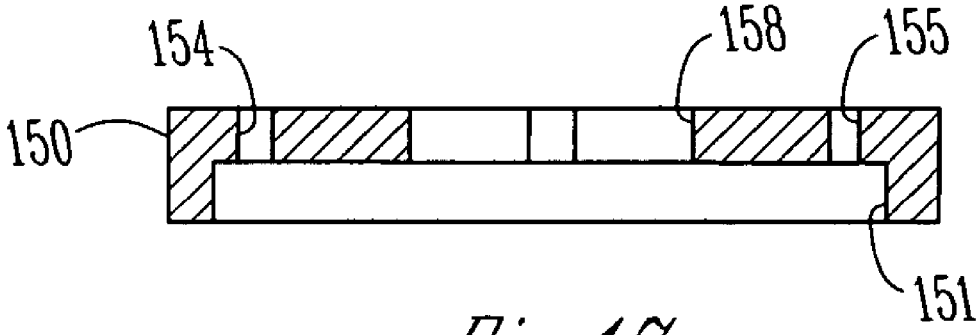
FIG. 17 illustrates a cross-sectional view of the center plate shown in FIG. 16 taken along line 156 of FIG. 16.

FIG. 17 illustrates a cross-sectional view of the center plate 150 shown in FIG. 16 taken along line 156 of FIG. 16. Seen in FIG. 17 is a recess 151 in the bottom surface of center plate 150.

Figure 18:
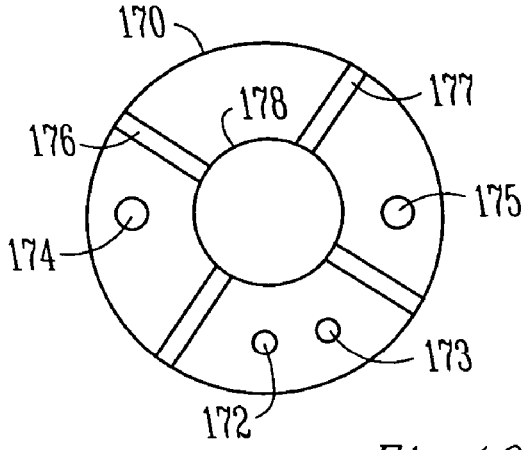
FIG. 18 illustrates a top view of a pin receptor of a fastener installation tool, in accordance with one embodiment of the invention.

FIG. 18 illustrates a top view of a pin receptor 170 of a fastener installation tool, in accordance with one embodiment of the invention. Seen in FIG. 18 are central chamber 178, channels 172 and 173 to convey air and/or vacuum, holes 174 and 175 through which nose piece assembly bolts 192 pass, and channels 176 and 177 in the upper surface of pin receptor 170. All of these elements were described above with reference to FIG. 2.

Figure 19:
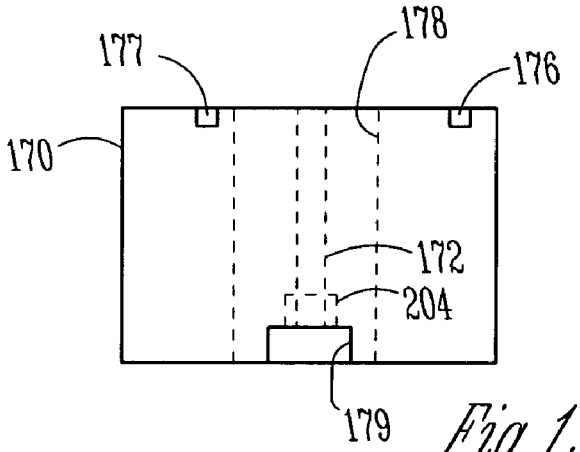
FIG. 19 illustrates a side view of the pin receptor shown in FIG. 18.

FIG. 19 illustrates a side view of the pin receptor 170 shown in FIG. 18. Seen in FIG. 19 are central chamber 178, channel 172 (channel 173 is not shown), and channels 176 and 177 in the upper surface of pin receptor 170. Channel 172 has an opening 179 in the lower surface of pin receptor 170. The lower portion 204 of channel 172 is threaded.

Figure 20:
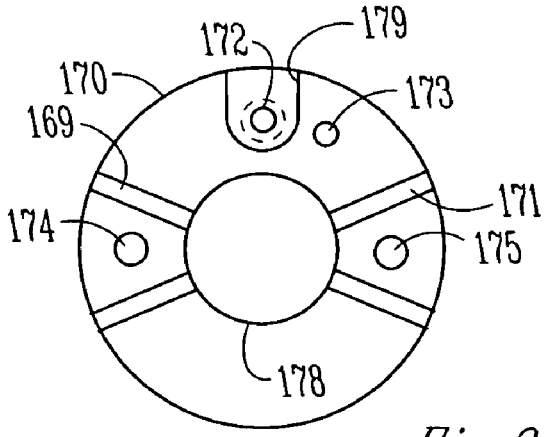
FIG. 20 illustrates a bottom view of the pin receptor shown in FIG. 18.

FIG. 20 illustrates a bottom view of the pin receptor 170 shown in FIG. 18. Seen in FIG. 20 are central chamber 178, channels 172 and 173, opening 179, holes 174 and 175, and channels 169 and 171 in the lower surface of pin receptor 170.

Figure 21:
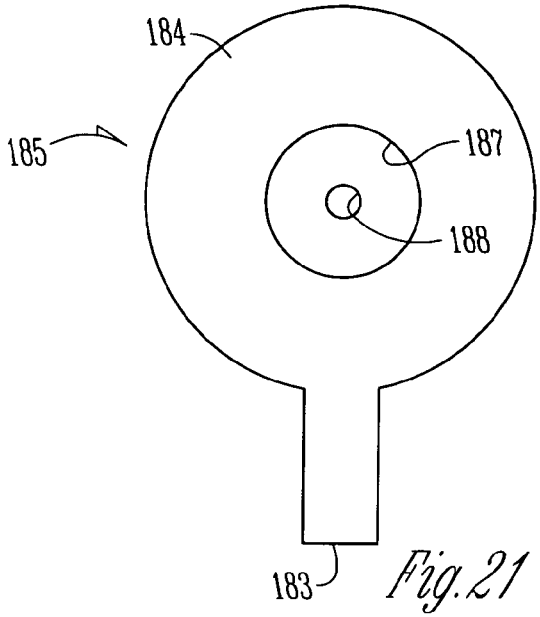
FIG. 21 illustrates a top view of a tip adapter of a fastener installation tool, in accordance with one embodiment of the invention.

FIG. 21 illustrates a top view of a tip adapter 185 of a fastener installation tool, in accordance with one embodiment of the invention. Seen in FIG. 21 are flange 184, circular recess 187 in the upper surface of flange 184, channel 188, and tab 183. All of these elements were described above with reference to FIG. 2.

Figure 22:
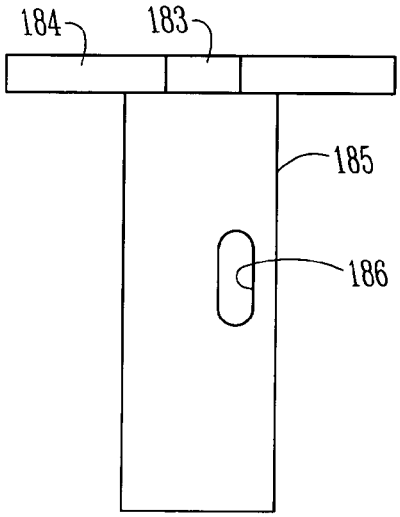
FIG. 22 illustrates a side view of the tip adapter shown in FIG. 21.

FIG. 22 illustrates a side view of the tip adapter 185 shown in FIG. 21. In this view we are looking head-on at the end of tab 183. Seen in FIG. 22 is hole 186 that communicates with channel 188 (FIGS. 21 and 23).

Figure 23:
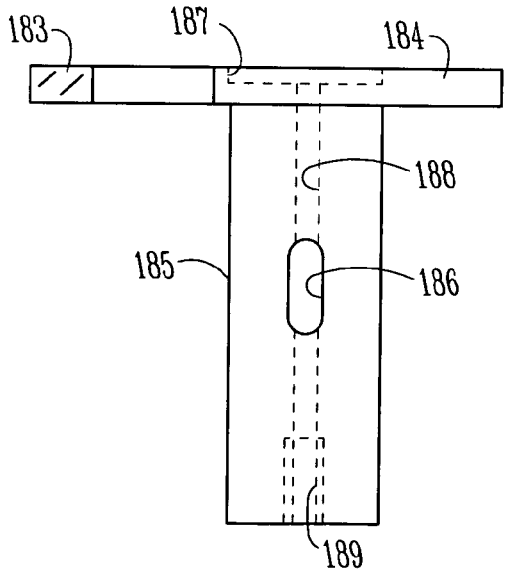
FIG. 23 illustrates another side view of the tip adapter shown in FIG. 21.

FIG. 23 illustrates another side view of the tip adapter 185 shown in FIG. 21. In this view we are looking head-on at hole 186. Also seen in FIG. 23 is the threaded lower portion 189 of channel 188.

Figure 24:
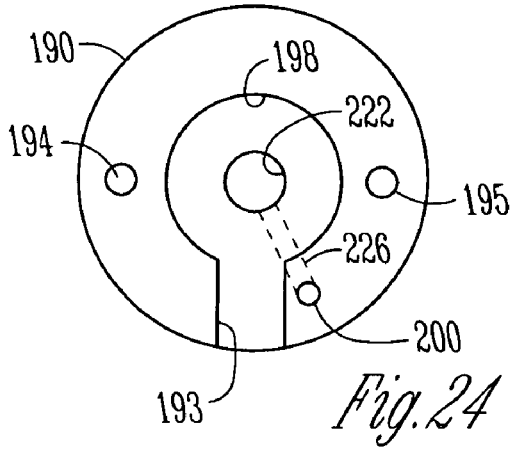
FIG. 24 illustrates a bottom view of a nose piece of a fastener installation tool, in accordance with one embodiment of the invention.

FIG. 24 illustrates a bottom view of a nose piece 190 of a fastener installation tool, in accordance with one embodiment of the invention. Seen in FIG. 24 are opening 198, channel 193, central chamber 222, opening 200, passage 226, and bolt holes 194 and 195. All of these elements were described above with reference to FIG. 2.

Figure 25:
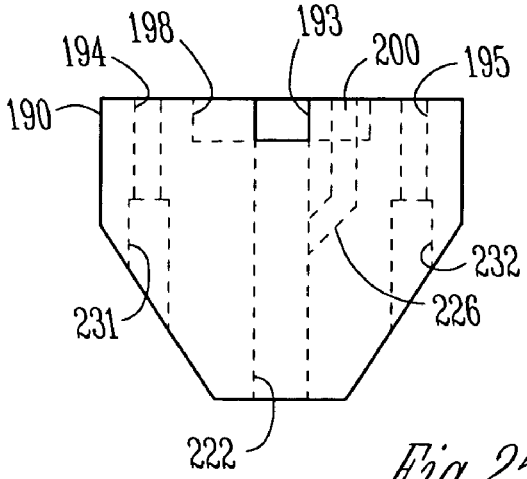
FIG. 25 illustrates a side view of the nose piece shown in FIG. 24.

FIG. 25 illustrates a side view of the nose piece 190 shown in FIG. 24. In this view we are looking head-on into channel 193. Seen in FIG. 25 are opening 198, channel 193, central chamber 222, opening 200, passage 226, and bolt holes 194 and 195. Also seen in FIG. 25 are bolt recesses 231 and 232. All of these elements were described above with reference to FIG. 2.

Figure 26:
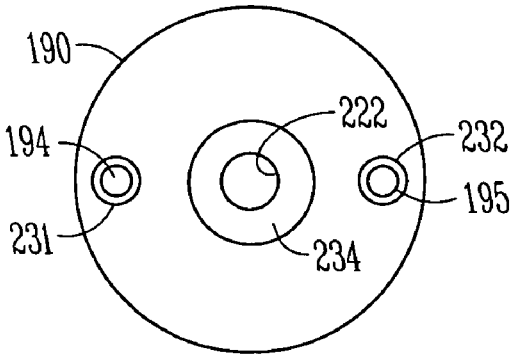
FIG. 26 illustrates a top view of the nose piece shown in FIG. 24.

FIG. 26 illustrates a top view of the nose piece 190 shown in FIG. 24. Seen in FIG. 26 are central chamber 222, bolt holes 194 and 195, and bolt recesses 231 and 232. Also seen in FIG. 26 is the snub end 234 of nose piece 190.

Figure 27:
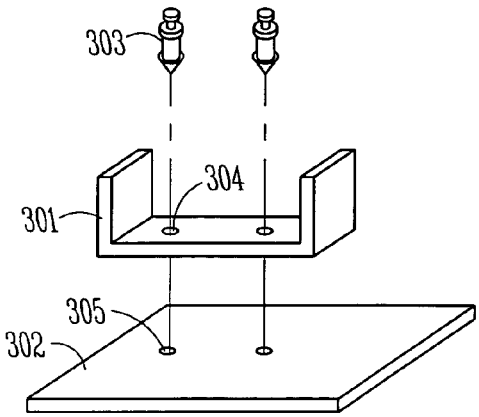
FIG. 27 illustrates a perspective view of two work pieces to be coupled by fasteners inserted in accordance with one embodiment of the invention.

FIG. 27 illustrates a perspective view of two work pieces 301 and 302 to be coupled by fasteners 303 inserted in accordance with one embodiment of the invention. Work piece 301 having a pair of holes 304 is aligned with work piece 302 having a pair of holes 305. Fasteners 303 are to be inserted into holes 304 and 305. One of fasteners 303 is inserted into fastener channel 210 of tip 197 (refer to FIG. 2) of tool 10, and the fastener 303 is driven into one aligned pair of holes 304 and 305. Next another fastener 303 is inserted into tool 10, and that fastener 303 is driven into the other aligned pair of holes 304 and 305.

Figure 28:
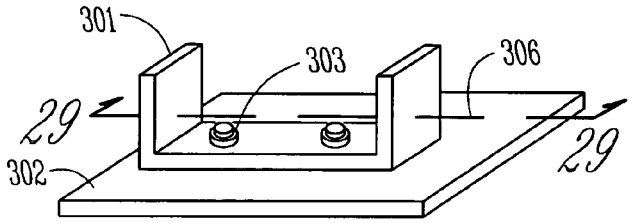
FIG. 28 illustrates a perspective view of the work pieces of FIG. 27 after one work piece has been coupled to the other by fasteners inserted in accordance with one embodiment of the invention.

FIG. 28 illustrates a perspective view of the work pieces of FIG. 27 after one work piece 301 has been coupled to the other work piece 302 by fasteners 303 inserted in accordance with one embodiment of the invention.

Figure 29:
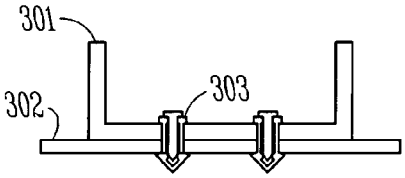
FIG. 29 illustrates a cross-sectional view of the work pieces of FIG. 28 taken along line 306 of FIG. 28.

FIG. 29 illustrates a cross-sectional view of the work pieces of FIG. 28 taken along line 306 of FIG. 28.

Figure 30:
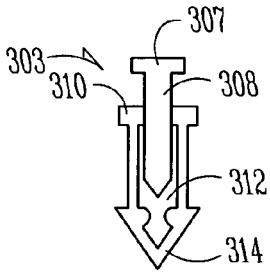
FIG. 30 illustrates a cross-sectional view of a fastener prior to insertion by one embodiment of the invention.

FIG. 30 illustrates a cross-sectional view of a fastener 303 prior to insertion by one embodiment of the invention. Fastener 303, fabricated of plastic, comprises a body 310 having a central chamber 312 and a head 314. Fastener 303 also comprises a tail 308 that is generally columnar with the exception of a point on one end and a drive plate 307 on the other end. When used in tool 10, fastener 303 is manually inserted tail-first into fastener channel 210 of tip 197 (FIG. 2) of tool 10.

Figure 31:
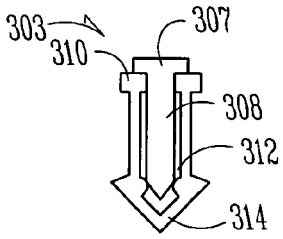
FIG. 31 illustrates a cross-sectional view of a fastener following insertion by one embodiment of the invention.

FIG. 31 illustrates a cross-sectional view of a fastener 303 following insertion by one embodiment of the invention. As seen in FIG. 31, the drive plate 307 of fastener 303 has been struck by hammer pin 162 (FIG. 2) of the secondary hammer assembly 163, thereby driving tail 308 downward through central chamber 312 into the head 314 of fastener 303. As a result, head 314 is spread sufficiently to retain fastener 303 within a hole of appropriate dimension into which fastener 303 has been driven. Although a plastic rivet is illustrated in FIG. 31, many other types of fasteners can be driven by tool 10, and such fasteners can be formed of any suitable material.

Figure 32:
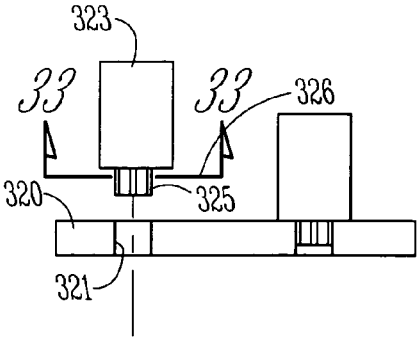
FIG. 32 illustrates a cross-sectional view of a pair of stand-offs.

FIG. 32 illustrates a cross-sectional view of a pair of stand-offs 323. The stand-off 323 on the left-hand side of FIG. 32 is illustrated prior to insertion into a hole 321 of a work piece 320 by tool 10, while the stand-off on the right-hand side of FIG. 32 is shown following insertion by tool 10. Each stand-off 323 is generally circular in cross-section and comprises a ribbed or finned head portion 325 of relatively smaller diameter than the main body of stand-off 323. A stand-off 323 is inserted tail-first into an appropriately dimensioned fastener channel 210 of tip 197 (FIG. 2) of tool 10. When tool 10 is actuated, the rear of stand-off 323 is struck by hammer pin 162 (FIG. 2) of the secondary hammer assembly 163, thereby driving the finned head portion 325 of stand-off 323 into an appropriately dimensioned hole. The fins on the finned head portion 325 are compressed and serve to retain the stand-off 323 in the hole via expansion forces.

Figure 33:
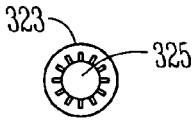
FIG. 33 illustrates a cross-sectional view of one of the stand-offs of FIG. 32 taken along line 326 of FIG. 32.

FIG. 33 illustrates a cross-sectional view of one of the stand-offs 323 of FIG. 32 taken along line 326 of FIG. 32. Seen in FIG. 33 is the circular cross-section of stand-off 323. Also seen in FIG. 33 is the circular cross-section of the head portion 325 of stand-off 323.

Figure 34:
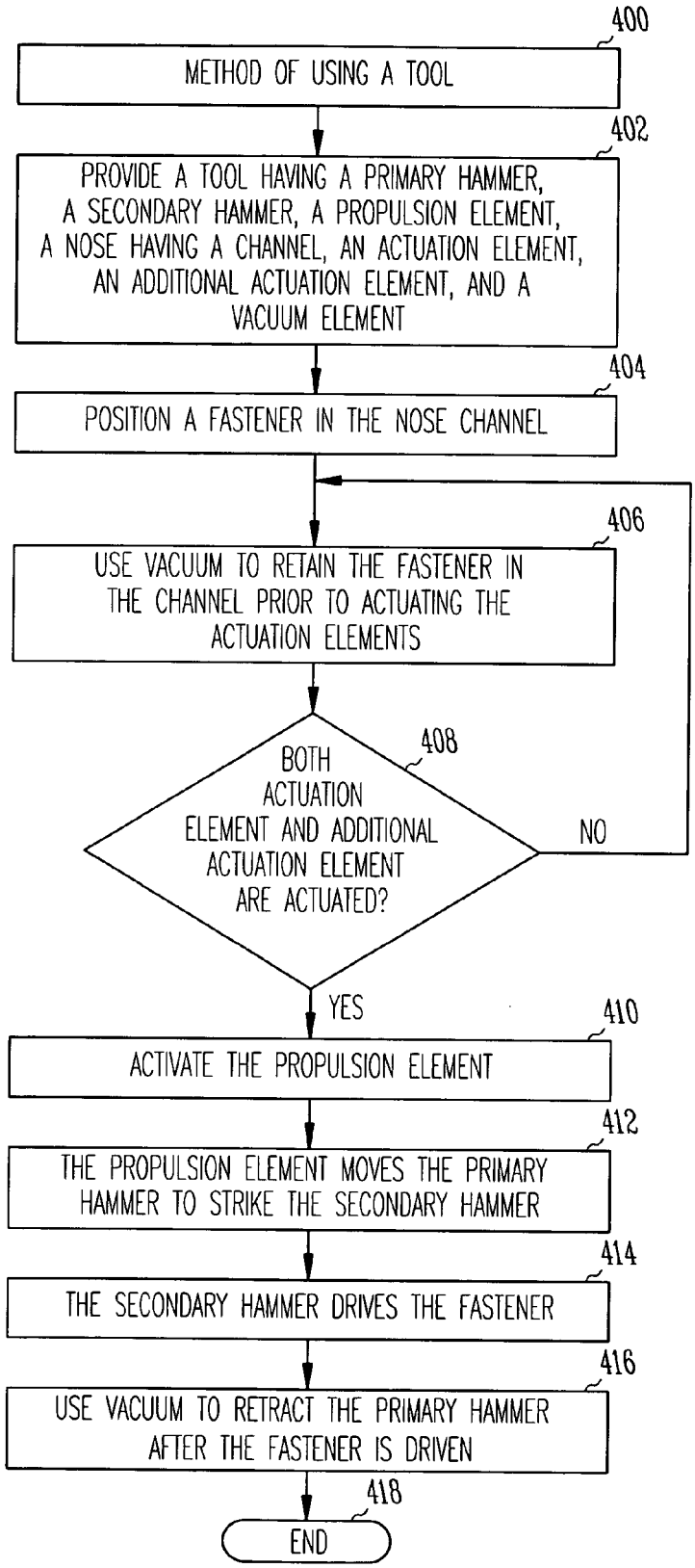
FIG. 34 illustrates a flow diagram of a method of using a fastener installation tool, in accordance with one embodiment of the invention.

FIG. 34 illustrates a flow diagram of a method 400 of using a fastener installation tool, in accordance with one embodiment of the invention.

In 402, a tool is provided having a primary hammer, a secondary hammer, a propulsion element (such as air pressure and associated air delivery infrastructure), a nose having a channel, an actuation element (such as actuation button 101), an additional actuation element (such as tip adapter 185), and a vacuum element (such as vacuum and associated vacuum delivery infrastructure).

In 404, a fastener is positioned in the nose channel.

In 406, vacuum is used to retain the fastener in the nose channel prior to actuating the actuation elements.

In 408, a determination is made whether both the actuation element and the additional actuation element are actuated. If so, the method proceeds to 410; otherwise, the method returns to 406.

In 410, the propulsion element is activated.

In 412, the propulsion element moves the primary hammer to strike the secondary hammer.

In 414, the secondary hammer drives the fastener.

In 416, vacuum is used to retract the primary hammer after the fastener is driven. The method ends at 418.

Although FIG. 34 depicts the method as having an "end", it will be understood that the method can be indefinitely repeated.

OPERATION

In operation, control system 20 is coupled to air source 30. In one embodiment, air source 30 supplies air at approximately 100 pounds per square inch (PSI) (7 Bar). Air regulator 40 is adjusted until gauge 45 reads approximately 65 PSI (4.5 Bar), and air regulator 50 is adjusted until gauge 55 reads approximately 35 PSI (2.5 Bar). The output of air regulator 50 is provided via air line 54 to vacuum generator 70. Vacuum generator 70 operates according to the Venturi principle to generate a vacuum in vacuum line 74.

Limit valve 80 is coupled to line 44, line 64, and pilot hose 84. Limit valve 80 operates as follows. When air is flowing to tool 10 through pilot hose 84 without being blocked within tool 10 by the simultaneous depression of button 101 and tip 185, the air within pilot hose 84 is relatively unpressurized, and limit valve 80 does not let air flow from line 44 through limit valve 80 to line 64. The air within pilot hose 84 only becomes pressurized when actuation button 101 and tip 185 are concurrently depressed. When pilot hose 84 is pressurized, limit valve 80 causes air to flow from line 44 through limit valve to pressurize line 64.

Reversing valve 60 is coupled to line 44, line 64, line 74, and supply hose 86. Reversing valve operates as follows. When line 64 from limit valve 80 is not pressurized, vacuum is connected from line 74 to supply hose 86. When line 64 is pressurized, air pressure is connected to supply hose 86 from line 44.

The operation of tool 10 when in standby mode will now be discussed. Standby mode occurs during any of the following conditions: 1) actuator button 101 is not being depressed by the operator, or 2) tip 185 is not being depressed by movement of the tool 10 against a work piece, or 3) neither button 101 or tip 185 is being depressed. In other words, tool 10 is in active mode only when button 101 and tip 185 are simultaneously depressed; however, active mode will be described later below.

With reference to FIGS. 1 and 2, in standby mode, air from pilot hose 84 flows through pilot hose adaptor 119 into input manifold 114, and from there it flows out of vent or air pilot gasket 112 into the ambient air. In addition, in standby mode, air flows from channel 215 (FIG. 8) of input manifold into channel 142 of body 140, with which channel 215 is coupled. From channel 142 of body 140, air flows through channel 152 of center plate 150, through channel 172 of pin receptor 170, and out of vent or air pilot gasket 180 into the ambient air. Air flowing out of vent 180 pushes tab 183 of tip adapter 185 against channel 193 and keeps it there (assuming that tool 10 is not actuated), so that tip adapter 185 is in its most downward position.

If button 101 is depressed by the operator, button tab 110 functions as a blocking element that makes contact with the aperture in vent 112, blocking off the air flowing from vent 112. Likewise, if the nose of tool 10 is pressed against a work piece by the operator, tip tab 183 operates as a blocking element to press against the aperture in vent 180, blocking off the air flowing from vent 180. So long as button 101 and tip 185 are not concurrently depressed, air will continue to flow from either or both of vents 112 and 180. As mentioned above, the air within pilot hose 84 becomes pressurized when actuation button 101 and tip 185 are concurrently depressed. When pilot hose 84 is pressurized, supply hose 86 switches from vacuum to air pressure, causing tool 10 to drive the fastener.

Before explaining the operation of tool 10 when supply hose 86 is providing air pressure, first the operation of tool 10 will be explained when supply hose 86 is supplying vacuum to tool 10. During standby mode, reversing valve 60 is supplying vacuum to supply hose 86, as mentioned earlier. With reference to FIG. 2, the vacuum of supply hose 86 is coupled to hose adaptor 120 of manifold 114.

From manifold 114, the vacuum is applied both to channel 216 (FIG. 8) and channel 218 (FIG. 8) of input manifold 114. Channel 218 communicates with central chamber 148 of body 140. Assuming that hammer 126 is at the downward position of its stroke, having struck head 160 to drive a fastener, when vacuum is applied to channel 216 and central chamber 148, hammer 126 is drawn upwards in central chamber 148 until its upper bumper 122 contacts the underside of manifold 114. Drawn into this position, hammer 126 is ready to be thrust downwardly against head 160 of the secondary hammer assembly 163.

The vacuum that is applied to channel 216 of manifold 114 is communicated through channel 143 of body 140, channel 153 of center plate 150, channel 173 of pin receptor, hole 200 of nose piece 190, passage 226 of nose piece 190, hole 186 of tip adapter 185, interior channel 188 of tip adapter 185, and interior channel 210 of tip 197. The vacuum applied to fastener channel 210 of tip 197 serves to retain a fastener within fastener channel 210, so that it doesn't fall out before tool 10 is actuated.

The various infrastructure of tool 10 that conducts vacuum to central chamber 148 of body 140, in order to retract hammer 126, and that conducts vacuum to the fastener channel 210 of tip 197, in order to retain a fastener within fastener channel 210, constitutes a vacuum element.

The actuation of tool 10 to drive a fastener will now be discussed. As mentioned above, when both tip 185 and button 101 are depressed, supply hose 86 switches from vacuum to air pressure. The air pressure is applied through supply hose adapter 120 of input manifold 114, and into channel 214 (FIGS. 8–9) of manifold 114. From channel 214, air pressure is applied out of manifold through channel 218 and into the central chamber 148 of body 140. Concurrently, air is blocked from moving through channel 216 through channel 143 of body 140 by ball 136 moving downwardly within channel 143, whose upper region is slightly enlarged to hold ball 136 in a one-way valve arrangement.

When air is supplied into the central chamber 148 of body 140, hammer 126 is quickly thrust downward until its lower bumper 132 passes through aperture 158 of center plate 150 and strikes head 160 of secondary hammer assembly 163, causing head 160 to move downward through the central chamber 178 of pin receptor 170. This drives the hammer pin 162 downward through interior channel 188 of tip adapter 185, and through fastener channel 210 of tip 197, striking the tail of the fastener, such as tail 308 of fastener 303 (FIG. 30). As hammer 126 is thrust downward, its washer 130 comes into contact with the upper surface of center plate 150, halting the downward movement of hammer 126. After secondary hammer assembly 163 strikes the fastener, secondary hammer assembly 163 is returned to its standby position by the compression force of hammer assembly spring 164.

Because the kinetic energy of hammer 126 is transferred to secondary hammer assembly 163 and to the fastener, there is a minimum of kick-back to the tool operator. In other words, the fastener is driven without causing an appreciable reactive force upon the tool in a direction opposite to that in which the fastener is driven.

Providing upper bumper 122, washer 130, and lower bumper 132 of a resilient material reduces wear and possible damage that might otherwise be caused by metal striking metal.

The various infrastructure of tool 10 that conducts air pressure to the central chamber 148 of body 140, in order to drive primary hammer 126 into head 160 of secondary hammer assembly 163, constitutes a pneumatic element or propulsion element.

The return of tool 10 to standby mode will now be described. When either button 101 or tip adapter 185 is released, air from pilot hose 84 can vent out through vents 112 and/or 180. When the air pressure within pilot hose 84 drops, limit valve 80 is tripped, resulting in the depressurization of line 64, causing reversing valve 60 to connect vacuum to supply hose 86.

The inventive subject matter provides for a fastener installation tool to install fasteners with only minimal reactive forces to the operator's hand, thus reducing the risk of repetitive injuries to the operator's body. The fastener operates upon a combination of vacuum and air pressure. A hammer pin for driving the fastener is physically independent of an air-pressure driven piston, so that the hammer pin is thrust against the fastener using kinetic energy without appreciable kick-back to the operator. The fastener installation tool reduces repetitive motion injuries to an operator. The fastener installation tool is light and can be easily held in one hand. The fastener installation tool is relatively inexpensive and can be used with a wide variety of fastener types, thus reducing production costs of equipment having components that require fasteners, so that such equipment can be more commercially competitive.

As shown herein, the inventive subject matter can be implemented in a number of different embodiments, including but not limited to a fastener installation tool and various methods for using a fastener installation tool. Other embodiments will be readily apparent to those of ordinary skill in the art.

For example, although tool 10 is illustrated as comprising a pair of actuation elements, in the form of actuation button 101 and tip adapter 185, that must be concurrently actuated to fire the tool, embodiments of the invention are not limited to such an arrangement, and they could be implemented with only one actuation element or with more than two actuation elements if desired.

In addition, while an embodiment has been illustrated in which the control mechanism provides vacuum to the supply hose when air within the pilot hose has greater than a predetermined pressure, and wherein the control mechanism provides air pressure within the supply hose when air within the pilot hose has less than a predetermined pressure, in other embodiments, this could be different. For example, the control mechanism could provide vacuum to the supply hose when air within the pilot hose has less than a predetermined pressure, and the control mechanism could provide air pressure within the supply hose when air within the pilot hose has more than a predetermined pressure.

The architecture, composition, materials, dimensions, and sequence of operations can all be varied to accommodate different types of fasteners, the particular requirements of fastener installation tools, and different types of equipment that requires fasteners.

The various elements depicted in the drawings are merely representational and are not drawn to scale. Certain proportions thereof may be exaggerated, while others may be minimized. The drawings are intended to illustrate various implementations of the inventive subject matter, which can be understood and appropriately carried out by those of ordinary skill in the art.

Although specific embodiments have been illustrated and described herein, it will be appreciated by those of ordinary skill in the art that any arrangement that is calculated to achieve the same purpose may be substituted for the specific embodiment shown. This application is intended to cover any adaptations or variations of the inventive subject matter. Therefore, it is manifestly intended that embodiments of this invention be limited only by the claims and the equivalents thereof.

What is claimed is:

1. A tool control system comprising:

a pneumatic source;

a vacuum source;

a control mechanism coupled to the pneumatic source, to the vacuum source, to a supply hose, and to a pilot hose, wherein the supply hose and the pilot hose are to couple to a tool, wherein the control mechanism is to provide vacuum to the supply hose when air within the pilot hose has less than a predetermined pressure, wherein the control mechanism is to provide air pressure to the supply hose when air within the pilot hose has greater than the predetermined pressure, and wherein the control mechanism includes a limit valve coupled to the pneumatic source and to the pilot hose, and a reversing valve coupled to the limit valve, to the vacuum source, to the pneumatic source, and to the supply hose.

2. The tool control system recited in claim 1, wherein the limit valve is to couple the reversing valve to the vacuum source when air within the pilot hose has less than the predetermined pressure, and wherein the limit valve is to couple the reversing valve to the pneumatic source when air within the pilot hose has greater than the predetermined pressure.

3. A system comprising:

an air source;

a vacuum source;

a control mechanism coupled to the air source and to the vacuum source, wherein the air source and the vacuum source are to couple to a tool comprising a first operator-depressible actuation element and a second operator-depressible actuation element, wherein the control mechanism is to provide vacuum to the tool when fewer than both actuation elements are actuated, wherein the control mechanism is to provide air pressure to the tool when both actuation elements are actuated, and wherein the control mechanism includes a limit valve coupled to the air source and to the pilot hose, and a reversing valve coupled to the limit valve, to the vacuum source, to the air source, and to the supply hose;

and wherein the system further includes a supply hose selectively coupleable to the air source or to the vacuum source; and a pilot hose coupled to the first and second actuation elements, wherein the supply hose and the pilot hose are to couple to the tool.

4. The system recited in claim 3, wherein the control mechanism is to provide vacuum to the supply hose when air within the pilot hose has less than a predetermined pressure, and wherein the control mechanism is to provide air pressure to the supply hose when air within the pilot hose has greater than the predetermined pressure.

5. The system recited in claim 3, wherein the limit valve is to couple the reversing valve to the vacuum source when air within the pilot hose has less than the predetermined pressure, and wherein the limit valve is to couple the reversing valve to the air source when air within the pilot hose has greater than the predetermined pressure.

6. A system comprising:

an air source;

a vacuum source;

a control mechanism coupled to the air source and to the vacuum source, wherein the control mechanism is to couple to a tool comprising a first operator-actuatable actuation element and a second operator-actuatable actuation element, wherein the control mechanism includes a limit valve coupled to the air source and to the pilot hose, and a reversing valve coupled to the limit valve, to the vacuum source, to the air source, and to the supply hose;

and wherein the system further includes a pilot hose coupled to the control mechanism, wherein air within the pilot hose has less than a predetermined pressure when fewer than both actuation elements are actuated, and wherein air within the pilot hose has greater than a predetermined pressure when both actuation elements are actuated; and a supply hose selectively coupleable to the air source or to the vacuum source;

wherein the supply hose and the pilot hose are to couple to the tool.

7. The system recited in claim 6, wherein the control mechanism is to provide vacuum to the supply hose when air within the pilot hose has less than a predetermined pressure, and wherein the control mechanism is to provide air pressure to the supply hose when air within the pilot hose has greater than the predetermined pressure.

8. The system recited in claim 6, wherein the limit valve is to couple the reversing valve to the vacuum source when air within the pilot hose has less than the predetermined pressure, and wherein the limit valve is to couple the reversing valve to the air source when air within the pilot hose has greater than the predetermined pressure.

* * * * *